United States Patent [19]

Keil

[11] Patent Number: 5,003,911

[45] Date of Patent: Apr. 2, 1991

[54] ANTENNA POSITION WARNING DEVICE

[76] Inventor: Charles F. Keil, 783 Foresteria Ave., Wellington, Fla. 33414

[21] Appl. No.: 433,007

[22] Filed: Nov. 7, 1989

[51] Int. Cl.[5] ..... G08B 5/02

[52] U.S. Cl. ..... 116/28 R

[58] Field of Search ..... 116/28 R, 281, 283; 40/591, 592; 343/720, 882

[56] References Cited

U.S. PATENT DOCUMENTS

| | | | |
|---|---|---|---|
| 2,199,727 | 5/1940 | Koss | 343/714 |
| 2,214,685 | 9/1940 | Stone, Jr. | 343/882 |
| 3,232,265 | 2/1966 | Hurt | 116/28 R |
| 3,817,203 | 6/1974 | Brauer | 116/28 R |
| 4,101,897 | 7/1978 | Morrison | 343/715 |
| 4,418,636 | 12/1983 | Piper | 116/28 R |
| 4,490,917 | 1/1985 | Pilling | 116/28 R |
| 4,794,399 | 12/1988 | Sensibaugh | 343/760 |
| 4,807,557 | 2/1989 | Lodisio | 116/173 |

*Primary Examiner*—William A. Cuchlinski, Jr.
*Assistant Examiner*—W. Morris Worth
*Attorney, Agent, or Firm*—Victor F. Volk

[57] ABSTRACT

A signal object such as a colored ball is mounted to hang in front of the windshield of a RV when the TV antenna is up and to rise out of view when the antenna is lowered.

6 Claims, 1 Drawing Sheet

ANTENNA POSITION WARNING DEVICE

BACKGROUND OF THE INVENTION

Recreational vehicles are commonly equipped with television sets that are connected to an antenna that is mounted on the roof of the vehicle. These sets are not normally intended to be used while the vehicle is in motion on the road and the antenna should be lowered before it gets under way. Indeed, when a vehicle is being housed in a garage it may be necessary to lower the antenna before it can leave and may antennae have been destroyed for neglect of the required step of lowering them.

Modern antennae are adjustable from the inside of the vehicles on which they are installed and inspection of the handle or knob for this adjustment will inform the driver of the position of the antenna. But it is precisely the inadvertent omission of this inspection that most ofter leads to the disastrous getting under way of a vehicle while the antenna is raised. What is needed, and what my invention provides, is a warning that cannot be overlooked by a driver that his antenna is up and that he should not start the vehicle. It is also desirable that any warning device should be adaptable to most widely used antennae, that is should be inexpensive, and that almost anyone should be able to install it. These desiderata are achieved by means of the device hereinbelow described.

SUMMARY OF THE INVENTION

I have invented a warning device for use with recreational vehicles that have a front windshield and a roof-antenna means that is mounted to have an adjustable vertical angle. My device alerts the drive not to start the vehicle when the antenna is raised and has a flexible strand means with means, which may, advantageously, comprise a c-clamp, connecting one end to a point on the antenna that is distanced from the roof when the antenna is raised. The other end of the strand means is connected to a signal-object means that is visibly positioned in front of the windshield when the antenna, is raised. This positioning is accomplished by guide means for the strand means which may, advantageously, comprise a suction cup, and the signal-object means may, advantageously, comprise a ball of substantial weight.

When the roof-antenna means lowers in a direction away from the windshield my warning device advantageously will comprise additional guide means for the strand. This additional guide means is secured to the roof in a direction from the antenna away from the windshield so that raising the antenna will lower the signal-object means. My device may also, advantageously, comprise means for enclosing the signal-object means when the antenna is lowered.

DETAILED DESCRIPTION OF PREFERRED EMBODIMENT

Figure 1:
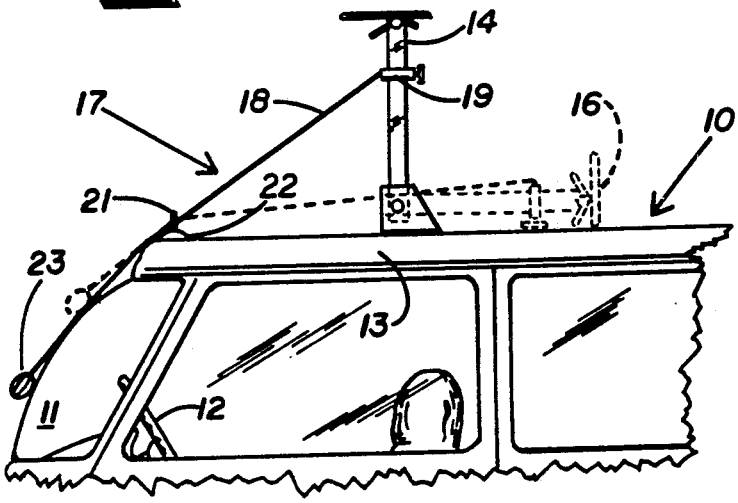
FIG. 1 is a side elevation of the device of my invention.
Figure 4:
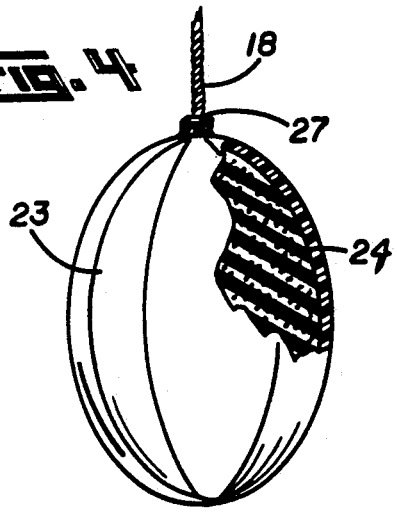
FIG. 4 is a view, partially in section, of a preferred signal object of my invention.

Referring, first, to FIG. 1, a recreational vehicle 10, a windshield 11, steering wheel 12, and roof 13 is equipped with a television or radio antenna 14 of known design such, for example as the Winegard RV-TV RVH-4A available from the Winegard Co. of Burlington, IA. The antenna 14 can usually be directed by means of a component (not shown) that extends from the underside of the roof 13 within the vehicle, to assume the operating, raised position of the antenna 14 or a lowered position 16 shown in phantom. The television is not normally used while the vehicle is in motion because there is scenery to watch and because of the danger of striking overhead objects such as bridges and the like. However, if he in not warned, the driver may very well start the vehicle 10 while the antenna 14 is still raised, and it is the purpose of the present invention to provide an unambiguous warning. My warning device designated overall by the numberal 17 comprises a strand 18 that is connected by means of a c-clamp 19 to an elevated point on the antenna 14. The strand 18 passes through an eyelet 21 mounted on a suction cap 22 that is firmly attached to the front of the car roof 13 or the top of the windshield 11. It will be understood that, while I have found advantages of economy and convenience in mounting an eyelet 21 on the suction cap 22 to form a strand guide other strand guides, such as eye screws threaded into the roof or eyelet supports cemented thereto may be used within the scope of my invention. A lower end of the strand 18 is tied to a signal object in the form of a brightly colored plastic ball 23 (see FIG. 4) that has been weighted with filler 24 to overcome the friction of the strand 18 against the different surfaces it will encounter when the antenna is raised from its lowered position 16.

Figure 3:
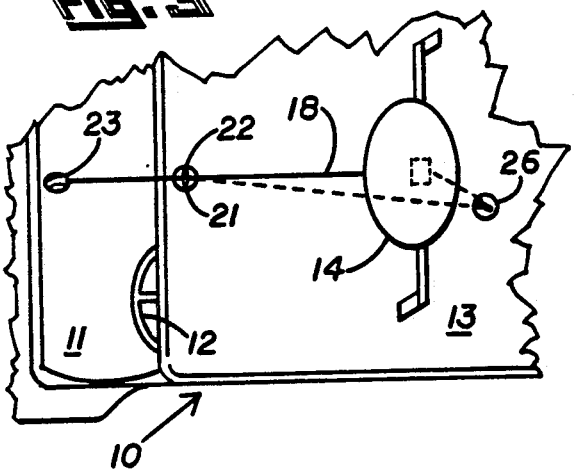
FIG. 3 is a plan view of the device of FIG. 1.

The ball 23 is prominently in the field of vision of the driver against the windshield 11 when the antenna 14 is raised but when the antenna is lowered toward the rear of the vehicle it is pulled up to the top of the windshield, thus indicating to the driver that he is free to start moving. However, as shown in FIG. 1, I prefer that the ball should remain visible to the driver at all times so that he may be sure that the device 17 is operating properly. Commercial antennae are usually constructed to lower towards the rear but my invention includes means for operating with antennae that lower in a forward (or side) direction. This comprises an additional suction-sup mounted eyelet 26 (FIG. 3) that can be mounted on the roof 13 in a direction away from that in which the antenna lowers.

I have described a c-clamp for connecting one end of the strand 18 to the antenna 14, but other means such as tying the strand directly around the antenna post or tying it to an eye screw embedded in the post may be used within the scope of my invention as may different means of connection the strand 18 to the ball 23, or other signal object. My ball 23 has a neck 27 to which the strand 18 is tightly knotted, but the ball might be perforated to provide attachment means or toggles inserted into the ball within the purview of my conception.

Figure 5:
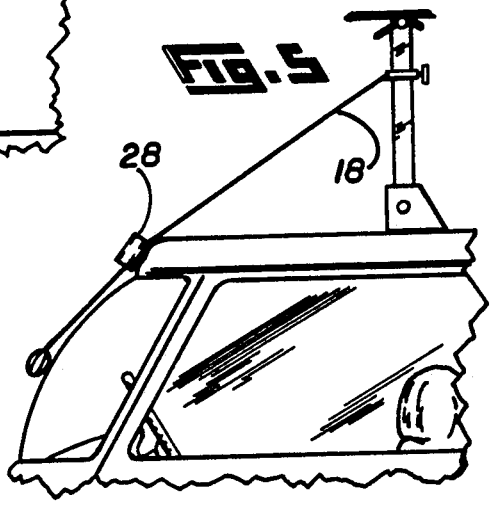
FIG. 5 is a side elevation of the device of FIG. 2.
Figure 2:
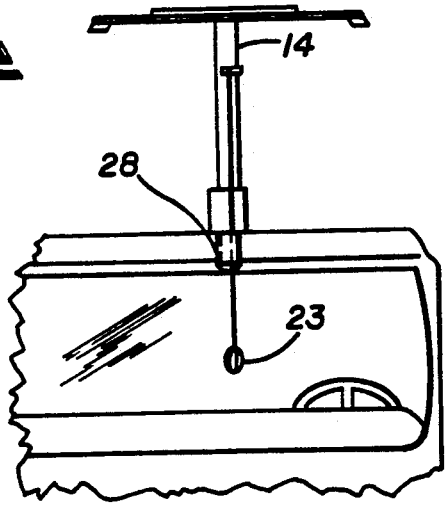
FIG. 2 is a front elevation of the device of FIG. 1 with means for enclosing the signal objects.

With reference to FIGS. 2 and 5 I have provided enclosing means for the ball 23 in the form of a cylindrical tube length 28 that is fastened to the roof 13 by means such as bolting, cementing, suctioning, etc. The tube length 28 serves to protect the ball 23 from wind and rain while the vehicle 10 is under way and can be painted to match the roof 13 so that the contrasting colored ball 23 is not visible. The ball is pulled into the tube length 28 by the strand 18 when the antenna 14 is lowered.

The foregoing description has been exemplary rather than definitive of my invention for which I desire an award of Letters Patent as defined in the appended claims.

I claim:

1. In combination, a recreational vehicle having a front windshield, a roof, and a roof antenna with an adjustable vertical angle, and a warning device mounted on said vehicle to indicate when said antenna is raised, said warning device comprising:

(A) a flexible strand, (B) antenna-connecting means connecting one end of said strand to a location on said antenna that is distanced from said roof when said antenna is raised, (C) signal-object means for warning of the elevation of said antenna, (D) means connecting the other end of said strand to said signal-object means and, (E) guide means for directing said strand whereby the weight of said signal-object means lowers said signal-object means visibly in front of said windshield when said antenna is raised, said signal-object being lowered a distance depending upon the location of attachment of said strand to said antenna.

2. The warning device of claim 1 wherein said signal-object means comprises a ball having substantial weight.

3. The warning device of claim 1 wherein said guide means comprises a suction-cup securable to said recreational vehicle.

4. The warning device of claim 1 wherein said roof antenna lowers in a direction toward said windshield and comprising additional guide meand for said strand, said additional guide means being secured to said roof in a direction from said antenna away from said windshield whereby lowering said antenna will withdraw said signal-object means.

5. The warning device of claim 1 wherin said antenna-connecting means comprises a c-clamp.

6. The warning device of claim 1 comprising means for enclosing said signal-object means when said antenna means is lowered.

* * * * *